US006655926B2

(12) United States Patent
Wang et al.

(10) Patent No.: US 6,655,926 B2
(45) Date of Patent: Dec. 2, 2003

(54) PORTABLE BLOWER

(76) Inventors: Hua-Chiang Wang, No. 2342, Sloan Dr., La Verne, CA (US) 91750; Hsin-Yen Lin, No. 11, Chuang Jou Road, HouLi Hsiang, Taichung Hsien (TW)

( * ) Notice: Subject to any disclaimer, the term of this patent is extended or adjusted under 35 U.S.C. 154(b) by 0 days.

(21) Appl. No.: 10/150,026

(22) Filed: May 20, 2002

(65) Prior Publication Data

US 2003/0035735 A1 Feb. 20, 2003

(30) Foreign Application Priority Data

Aug. 14, 2001 (TW) ..... 90213817 U

(51) Int. Cl.[7] ..... F04B 53/00; F04B 17/00; F01D 1/02

(52) U.S. Cl. ..... 417/234; 417/423.1; 415/206

(58) Field of Search ..... 417/234, 410.1, 417/423.1; 415/203, 206, 214.1

(56) References Cited

U.S. PATENT DOCUMENTS 3,809,504 A * 5/1974 Goossens ..... 417/411
D291,488 S * 8/1987 Delmas ..... D23/383
5,174,048 A * 12/1992 Shero ..... 415/206
5,324,178 A * 6/1994 Escaravage ..... 417/423.1
5,403,152 A * 4/1995 Trautloff et al. ..... 415/206
5,562,407 A * 10/1996 Cielo ..... 415/121.2
6,155,781 A * 12/2000 Tsai ..... 415/206
D443,054 S * 5/2001 Spaggiari ..... D23/370
6,435,818 B1 * 8/2002 Gatley, Jr. ..... 415/119

* cited by examiner

*Primary Examiner*—Cheryl J. Tyler
*Assistant Examiner*—Michael K. Gray
(74) *Attorney, Agent, or Firm*—Rosenberg, Klein & Lee

(57) ABSTRACT

A blower includes a casing for receiving a motor therein and the shaft of the motor extends through an opening in a top surface of the casing. A blade assembly is connected to the shaft and a cover is fixedly connected to the top surface of the casing and has an air outlet. The blade assembly is enclosed by the cover. Two recesses are defined in an outer periphery of the casing and a handle is connected to one of the two recesses, and an air inlet is defined in an inside of the other recess of the casing.

3 Claims, 3 Drawing Sheets

PORTABLE BLOWER

FIELD OF THE INVENTION

The present invention relates to a blower which has a casing in which a motor is received and a handle is connected to a side of the casing. The casing protects the motor from being accessed by water.

BACKGROUND OF THE INVENTION

A conventional blower generally includes a base with a motor connected to a top of the base and a shaft of the motor extends through a casing which has an opening. A blade assembly is connected to the shaft and located in the casing so that when the motor is operated, the blade assembly generates air flows toward the opening of the casing. However, the motor is exposed outside so that it tends to be rusted because moistures and rains. Furthermore, the whole assembly including the base, the motor and the casing are huge so that it is not convenient to be moved. In addition, the positioning of the motor and the casing requires a lot of bolts and it takes a lot of time to install the bolts one by one. The bolts are also incurred by rust.

The present invention intends to provide a portable blower that has a casing to enclose the motor therein and a handle is connected to the casing so that it is easily to be moved.

SUMMARY OF THE INVENTION

In accordance with one aspect of the present invention, there is provided a blower which comprises a casing having an opening defined in a top surface thereof and a plurality of sink areas are defined in the top surface and located around a periphery of the opening. To recesses are defined in an outer periphery of the casing and a handle is connected to one of the two recesses, and an air inlet is defined in an inside of the other recess of the casing.

A motor is enclosed by the casing and has a plurality lugs which are engaged with the sink areas. A shaft extends through the opening of the casing and a blade assembly is connected to the shaft.

A cover is fixedly connected to the top surface of the casing and has an air outlet. The blade assembly is enclosed by the cover.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
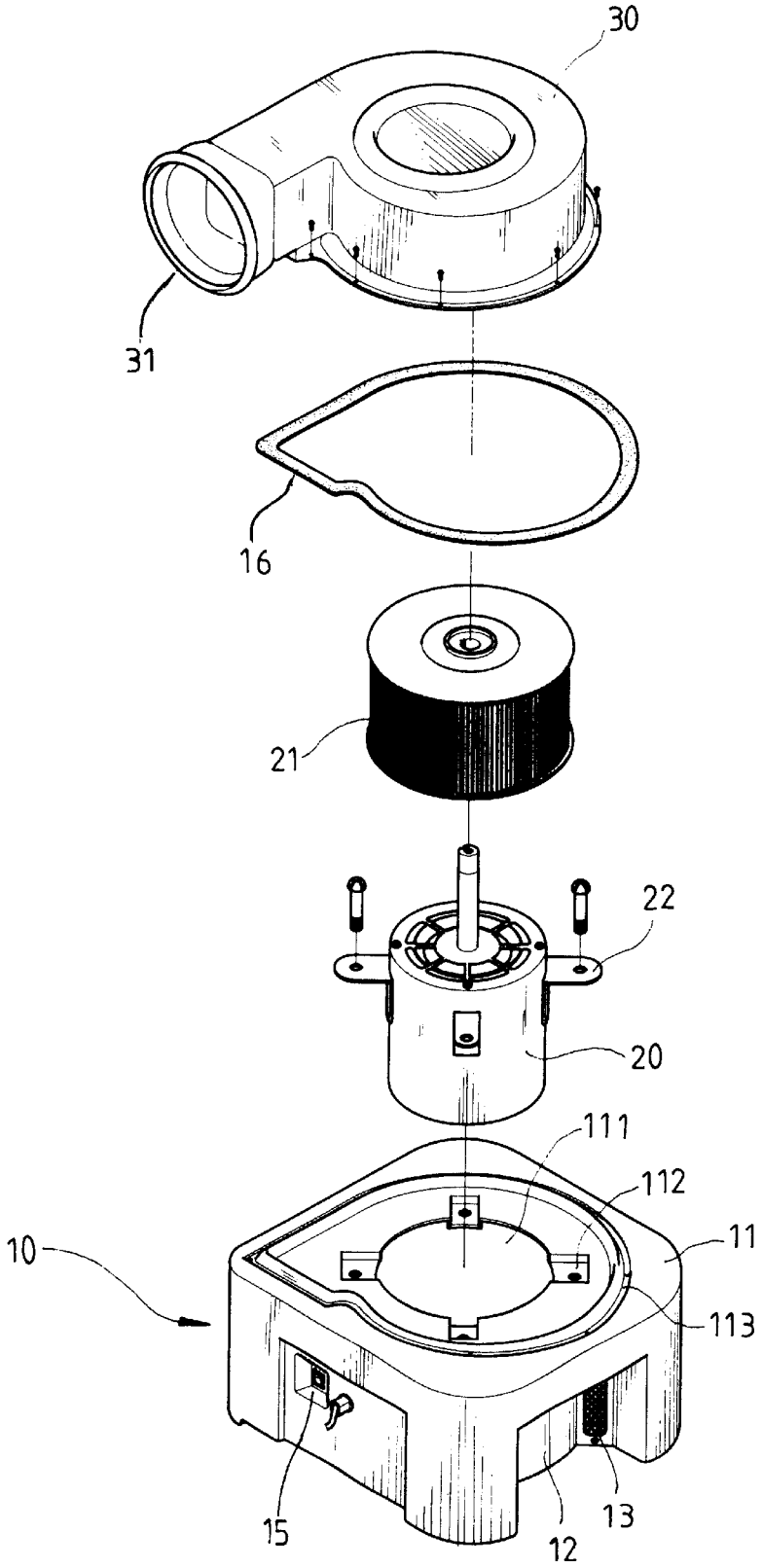
FIG. 1 is an exploded view to show the blower of the present invention.
Figure 2:
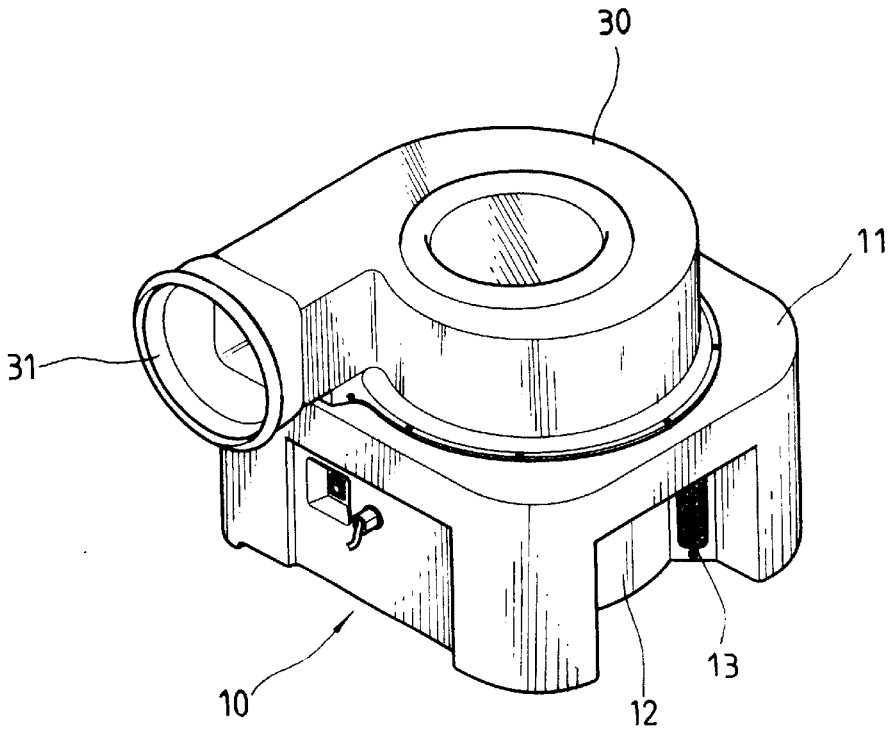
FIG. 2 is a perspective view to show the blower of the present invention.
Figure 3:
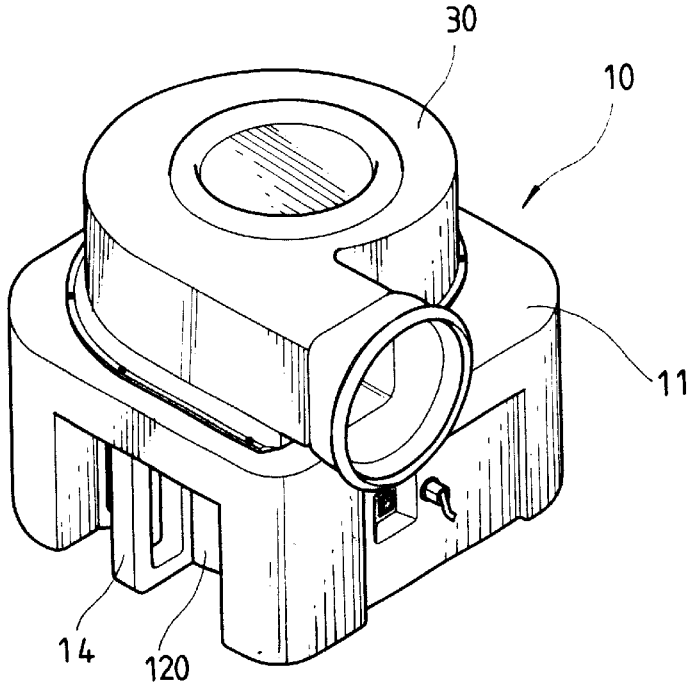
FIG. 3 is a perspective view to show the blower of the present invention and the handle is shown.
Figure 4:
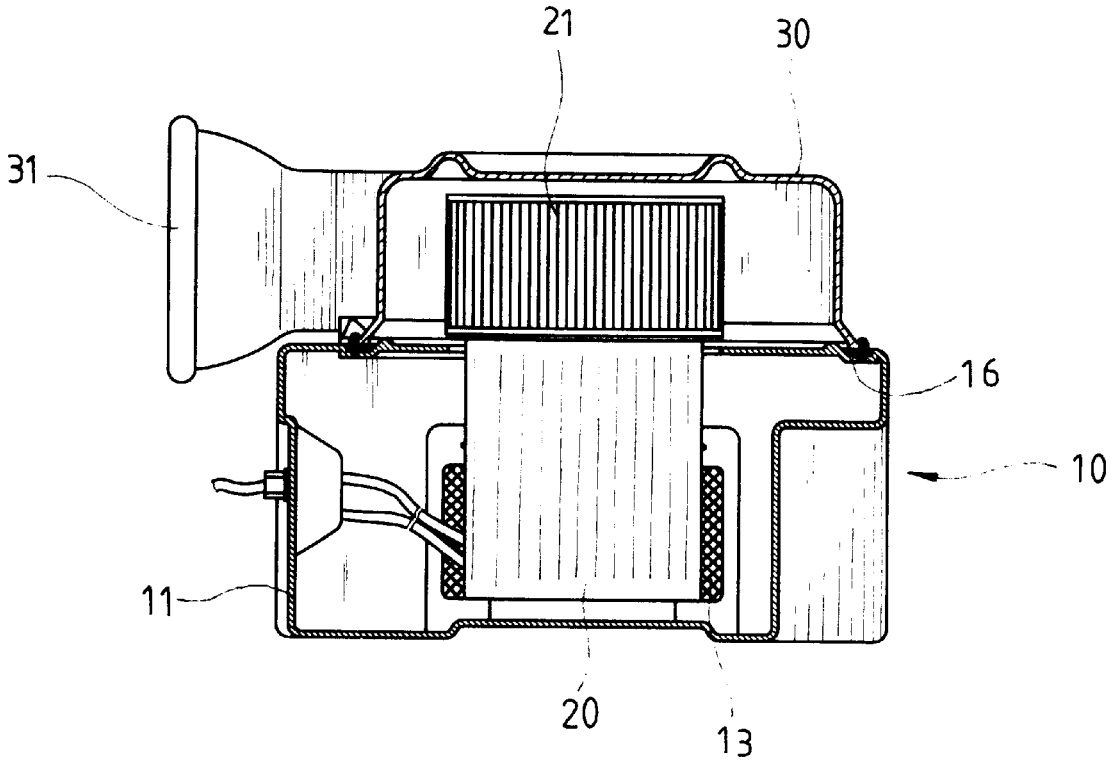
FIG. 4 is a cross sectional view to show the blower of the present invention.

Referring to FIGS. 1 to 4, the blower of the present invention comprises a casing 10 having four sides and a top surface 11. An opening 111 is defined in the top surface 11 of the casing 10 and two recesses 12 and 120 are defined in two sides of the casing 10. Four sink areas 112 are defined in the top surface 11 and located around a periphery of the opening 111. A handle 14 is connected to the casing 10 and located in the recess 120. An air inlet 13 is defined in an inside of the recess 12 of the casing 10. A switch 15 is connected to one of the other two sides of the casing 10.

A motor 30 is enclosed by the casing 10 and has four lugs 22 extending from the motor 30. The lugs 22 are engaged with the sink areas 112 and are fixed to the top surface 11 by bolts. A shaft of the motor 20 extends through the opening 111 of the casing 10 and a blade assembly 21 is connected to the shaft.

A groove 113 is defined in the top surface 11 of the casing 10 and a seal 16 is received in the groove 113. A periphery of an open bottom of the cover 30 is pressed on the seal 16. A cover 30 is fixedly connected to the top surface 11 of the casing 10 and has an air outlet 31. The blade assembly 21 is enclosed by the cover 30.

The casing 10 protects the motor 20 from being accessed by moisture and/or rain drops. The number of the air inlet 13 can be multiple and the air sucked from the air inlets 13 take the heat of the motor away. The handle 14 is convenient for the users to move the blower to desired positions.

While we have shown and described the embodiment in accordance with the present invention, it should be clear to those skilled in the art that further embodiments may be made without departing from the scope of the present invention.

What is claimed is:

1. A blower comprising:

a casing having an opening defined in a top surface of the casing and two recesses defined in an outer periphery of the casing, a handle connected to the casing and located in one of the two recesses, an air inlet defined in an inside of the other recess of the casing;

a motor enclosed by the casing and a shaft of the motor extending through the opening of the casing and a blade assembly connected to the shaft, and a cover fixedly connected to the top surface of the casing and having an air outlet, the blade assembly enclosed by the cover.

2. The blower as claimed in claim 1 further comprising a groove defined in the top surface of the casing and a seal received in the groove, a periphery of an open bottom of the cover pressed on the seal.

3. The blower as claimed in claim 1 further comprising a plurality of sink areas defined in the top surface and located around a periphery of the opening, a plurality of lugs extending from the motor and engaged with the sink areas.

* * * * *